US008070542B2

(12) United States Patent
Davis et al.

(10) Patent No.: US 8,070,542 B2
(45) Date of Patent: Dec. 6, 2011

(54) ENGINE EXHAUST BYPASS SYSTEM FOR OCEAN VESSEL

(75) Inventors: Joseph B. Davis, Richmond, TX (US); Gary T Leseman, Houston, TX (US); David A. Peth, Spring, TX (US)

(73) Assignee: Leseman Davis, LLC, Houston, TX (US)

( * ) Notice: Subject to any disclaimer, the term of this patent is extended or adjusted under 35 U.S.C. 154(b) by 142 days.

(21) Appl. No.: 12/334,180

(22) Filed: Dec. 12, 2008

(65) Prior Publication Data

US 2009/0156071 A1 Jun. 18, 2009

Related U.S. Application Data

(60) Provisional application No. 61/007,157, filed on Dec. 12, 2007.

(51) Int. Cl.
*B63H 21/00* (2006.01)

(52) U.S. Cl. ..... 440/89 R

(58) Field of Classification Search ..... 440/89 R; 114/201 R, 203, 116, 117; 277/608; 116/110.1; 292/281; 29/890.12
See application file for complete search history.

(56) References Cited

U.S. PATENT DOCUMENTS

| | | | | |
|---|---|---|---|---|
| 2,476,471 | A * | 7/1949 | Wilson | 114/117 |
| 3,221,493 | A * | 12/1965 | Meyer | 60/310 |
| 4,773,215 | A | 9/1988 | Winberg et al. | |
| 5,063,737 | A | 11/1991 | Lopez-Crevillen et al. | |
| 5,634,333 | A | 6/1997 | Tanaka et al. | |
| 5,822,984 | A | 10/1998 | Park | |
| 7,621,264 | B2 * | 11/2009 | Balsdon | 123/568.12 |

* cited by examiner

*Primary Examiner* — Daniel Venne
(74) *Attorney, Agent, or Firm* — Locke Lord LLP

(57) ABSTRACT

A primary exhaust bypass for a water-borne vessel having a seat member and a closure member coupled to the seat member, wherein the seat and closure members are configured to seal against exhaust leakage in the closed position and to allow exhaust leakage in the opened condition, and a locking mechanism, wherein the bypass is configured to open when the vessel lists a predetermined amount. A method of bypassing a blocked primary exhaust system may include establishing a bypass exhaust route, providing a normally-closed bypass mechanism at a distal portion of the bypass exhaust route, and changing the orientation of the bypass mechanism with respect to gravity, which may allow the bypass mechanism to open.

19 Claims, 7 Drawing Sheets

ENGINE EXHAUST BYPASS SYSTEM FOR OCEAN VESSEL

CROSS REFERENCE TO RELATED APPLICATIONS

This application is a non-provisional application of U.S. Provisional Patent Application Ser. No. 61/007,157, filed on Dec. 12, 2007, the entire contents and disclosure of which are incorporated by reference herein for all purposes.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

1. Field of the Invention

The inventions disclosed and taught herein relate generally to engine exhaust systems; and more specifically relates to an engine exhaust bypass system for ocean vessels when the primary exhaust system becomes blocked.

2. Description of the Related Art

Large diesel engines often power water-borne or ocean vessels, such as, but not limited to, ships and drilling rigs. Some examples of these vessels include Mobile Offshore Drilling Units, Offshore Production Platforms, semi-submersible drilling rigs, ships, tankers, and other boats. One or more of these vessels may have engine exhaust systems, pipes or conduits that exit the vessel relatively near the water line. Under normal operating conditions, this primary exhaust system operates at a particular exhaust system pressure, or back pressure. Diesel engines, for example, are known to be sensitive to exhaust system pressure and too much back pressure may stall a diesel engine or prevent it from starting.

If the vessel is in high seas or in a listing condition, such that the primary exhaust system outlet is under water, the exhaust system pressure likely will increase, and likely will increase to the stall pressure or non-starting pressure for that particular engine and exhaust system combination. For example, an ocean vessel, such as a semi-submersible offshore drilling rig, may have one or more primary engine exhaust system outlets exiting a side of the deck structure. If the underwater pontoons or tanks take on excess water, such as occurred to some rigs during and after Hurricane Katrina, the vessel may and likely will list. If the list causes the primary exhaust system outlet to be submerged, the affected engine or engines may stall or be prevented from starting. In the case of a semi-submersible drilling rig, engine power is needed to pump the excess water from the flooded tanks or pontoons to right the vessel.

Additionally, excess primary exhaust system pressure caused by undesired or abnormal vessel orientation also may cause adverse effects to the vessel's operation, such as excessive exhaust smoke, low power, excessive fuel consumption, efficiency losses, overheating, reduced engine life, or as another example, component failure.

The inventions disclosed and taught herein are directed to an improved engine exhaust system and method comprising an engine exhaust bypass system.

BRIEF SUMMARY OF THE INVENTION

In addition to the independent clams, which provide a concise summary of certain aspects of the inventions, the inventions described herein may be summarized as a primary exhaust bypass valve for a water-borne vessel. The bypass may include a seat member, such as a coaming or flange. The valve may include a closure member, such as a hatch or lid, which may be hingedly coupled to the seat member, such as to provide a closed position and at least one open position for the valve. The closed position may include sealing engagement between the seat member and the closure member, such as to prevent the leakage of exhaust through the valve. The open position may include any position wherein exhaust may flow through the valve. The valve may include a locking mechanism, such as a mechanism associated with a hinge coupled to the seat and closure members, wherein the locking mechanism may be configured to lock open the closure member in one or more open conditions. The bypass valve may be coupled to a water-borne vessel such that when the vessel lists a predetermined amount, which may include an abnormal orientation in which a primary exhaust outlet residing below the water line, the valve opens, such as to allow exhaust to bypass the primary outlet and other components of the exhaust system and to exit the vessel through the valve.

Another summary may be an exhaust system for a vessel, such as a water-borne vessel. The system may include a primary exhaust subsystem, which may include a primary conduit, a primary outlet, or other exhaust components. The system may include a bypass exhaust subsystem, which may include a bypass conduit. The bypass conduit may be coupled to the primary conduit or a bypass outlet. The system may include a bypass mechanism, which may be coupled to the bypass outlet, and which may include one or more components, such as a seat member, a closure member, or a locking mechanism. The seat and closure members may be hingedly coupled to one another, such as to provide one or more positions, which may include a closed position and at least one open position. The closed position may prevent the leakage of exhaust through the bypass outlet, while one or more open positions may allow exhaust to flow there through. The locking mechanism may be configured to fix the position of the closure member relative to the seat member, such as in one or more open positions. The bypass mechanism may be coupled to a vessel and configured so that the bypass mechanism remains closed during normal operations of the vessel, but opens when the vessel lists a predetermined amount with respect to the water line, which may include blockage of the primary exhaust outlet.

Yet another summary may be a method of bypassing a blocked primary exhaust system. The method may include establishing a bypass exhaust route, providing a normally-closed bypass mechanism at a distal portion of the bypass exhaust route, and changing the orientation of the bypass mechanism with respect to gravity, which may allow the bypass mechanism to open.

DETAILED DESCRIPTION

Figure 1:
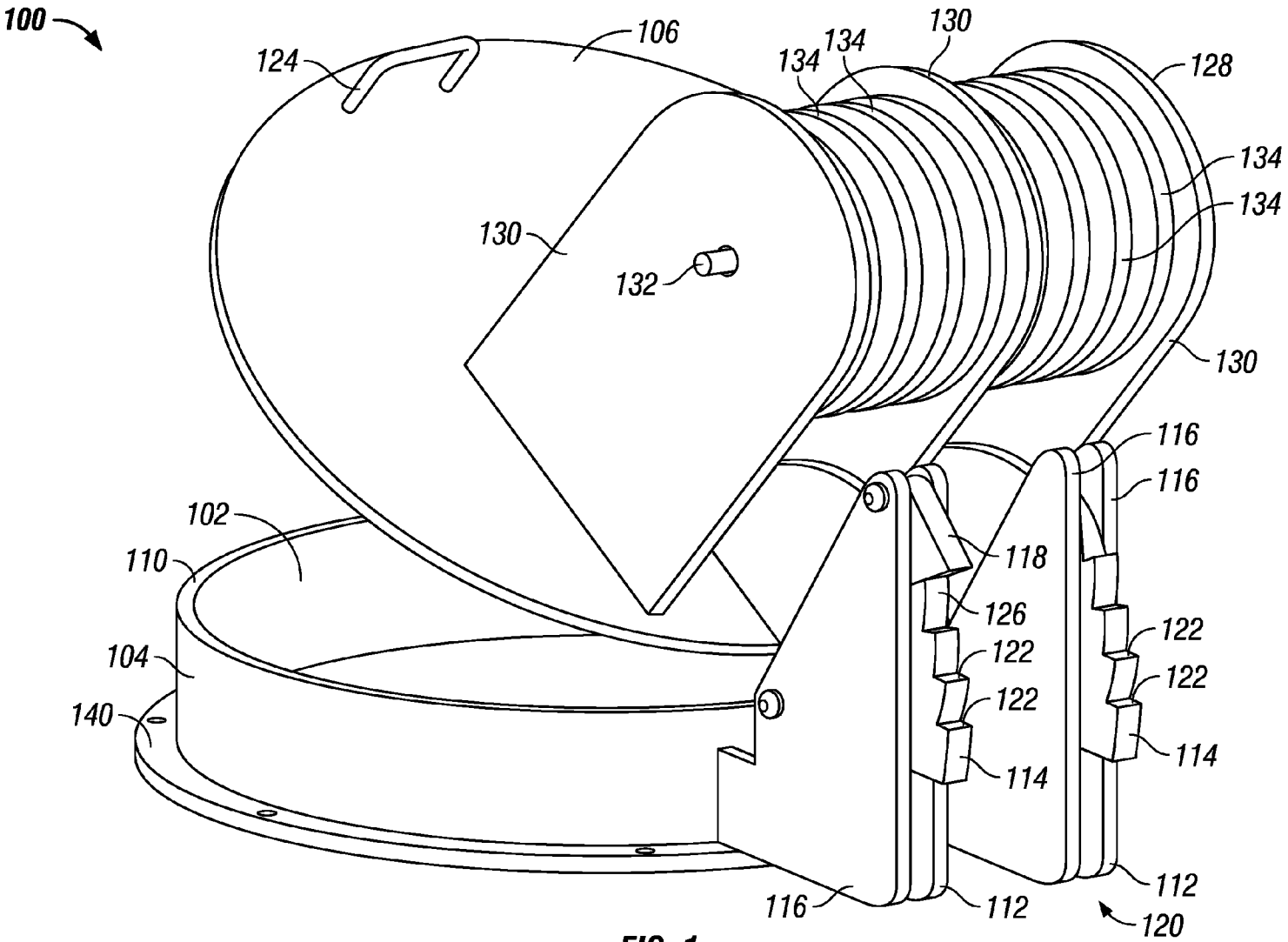
FIG. 1 illustrates one of many possible embodiments of an engine exhaust bypass system in an opened position and utilizing certain aspects of the present invention.

The Figures described above and the written description of specific structures and functions below are not presented to limit the scope of what Applicants have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present inventions will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation, location and from time to time. While a developer's efforts might be complex and time-consuming in an absolute sense, such efforts would be, nevertheless, a routine undertaking for those of skill in this art having benefit of this disclosure. It must be understood that the inventions disclosed and taught herein are susceptible to numerous and various modifications and alternative forms. Lastly, the use of a singular term, such as, but not limited to, "a," is not intended as limiting of the number of items. Also, the use of relational terms, such as, but not limited to, "top," "bottom," "left," "right," "upper," "lower," "down," "up," "side," and the like are used in the written description for clarity in specific reference to the Figures and are not intended to limit the scope of the invention or the appended claims. The term "couple," "coupled," "coupling," "coupler," and like terms are used broadly herein and can include any method or device for securing, binding, bonding, fastening, attaching, joining, inserting therein, forming thereon or therein, communicating, or otherwise associating, for example, mechanically, magnetically, electrically, chemically, directly or indirectly with intermediate elements, one or more pieces of members together and can further include without limitation integrally forming one functional member with another in a unity fashion. The coupling can occur in any direction, including rotationally.

We have created an improved system and method for bypassing a primary engine exhaust system for a vessel when the primary engine exhaust system pressure has increased to an undesirable level, such as may happen when the vessel is in an undesirable orientation. While the inventions descried herein have application to water-borne vessels, those of skill will appreciate that the inventions may be applied to land-based vehicles and other land-based systems, as needed.

Generally, a bypass system may include a bypass exhaust valve or outlet that is in fluid communication with a primary engine exhaust system. For example, if a primary exhaust system uses a silencer, the bypass system may be coupled to the silencer such that when the bypass system is active (e.g., bypass valve is opened) the exhaust is diverted from traveling through the silencer. The bypass exhaust valve or outlet is configured and structured such that, under normal engine and vessel operating conditions, the bypass system remains closed and all or substantially all engine exhaust exits the vessel through the primary engine exhaust system. The bypass exhaust valve or outlet is also configured and structured such that, under certain, predetermined abnormal engine operating conditions, the bypass system opens automatically and all or substantially all engine exhaust exits the vessel through the bypass engine exhaust system. In a preferred embodiment described in more detail below, the bypass system is configured and structured such that if the vessels lists or otherwise changes its orientation to an abnormal orientation and the primary exhaust system outlet becomes submerged, the bypass system will automatically open, based on increased exhaust pressure alone or a combination of orientation and increased engine exhaust pressure, to allow the engine to continue running or to be started or restarted.

As but one of many possible embodiments of our inventions described herein, a bypass exhaust system may comprise a valve or outlet having a seat portion, coaming or annularly-shaped member coupled to a bypass conduit or pipe. The coaming, for example, may be structured to keep water from entering the bypass conduit, for example, rain, water present on the deck, roof or other surface of the vessel to which the coaming may be coupled. The exhaust valve may include a closure member, such as a hatch or lid for sealing against the seat member. The closure member is preferably pivotally or hingedly coupled to, or with respect to, the seat member or coaming. The closure member and seat portion define a closed position in which exhaust gases are sealed or substantially sealed against passing there through (and, therefore, exit through the primary exhaust system). One or more weights may be coupled to the closure member, such as to the top of the hatch, for ensuring that the bypass system remains closed during normal engine and vessel operating conditions. For example, the combined weight of the closure member and any additional weights added thereto function to keep the bypass system in the closed condition to react the force created by the exhaust gas bearing on the closure member. The additional weights may also function to counterbalance the weight of the closure member when the bypass system is in the opened position.

The opened position may include any position, including a plurality of positions, of the closure member relative to the seat member in the members are not in sealing engagement, such as when exhaust gases are allowed to pass through the system. The bypass system may include a locking mechanism for fixing, temporarily or otherwise, the system in one or more of the opened positions. For example, when the hatch automatically opens, the locking mechanism may lock or fix the system in the opened position, until such time as the system is manually or automatically returned to the closed position.

Figure 2:
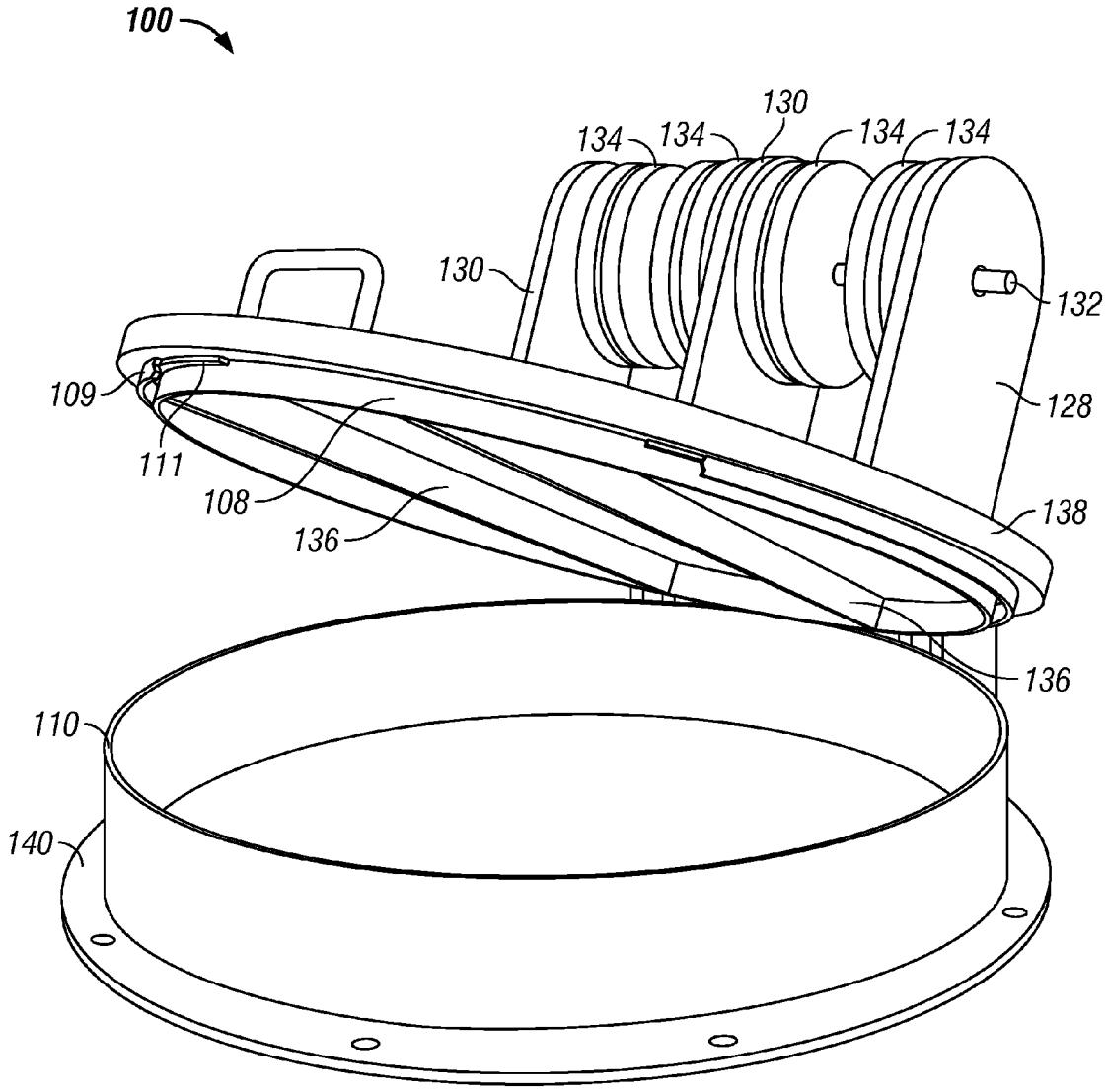
FIG. 2 illustrates another view of the engine exhaust bypass system of FIG. 1.

Turning now to a more specific description of one more physical embodiments of our inventions, FIG. 1 illustrates one of many embodiments of engine exhaust bypass system 100 in an opened position and utilizing certain aspects of the present invention. FIG. 2 illustrates another view of the engine exhaust bypass system of FIG. 1. FIGS. 1 and 2 will be described in conjunction with one another. While system 100 is shown to be annular or circular in shape in FIGS. 1 and 2, it will be appreciated that system 100 may be any shape required by a particular application, such as square, rectangular, triangular, polygon or another shape. System 100 may include a base or outlet, such as coaming 102, for coupling system 100 to a particular location, such as a deck or hull, and for coupling to a bypass conduit or pipe (not shown). For example, system 100 may be coupled to a deck, hull, platform or other location, for venting engine exhaust gases when the system is in the opened condition. In at least one embodiment, system 100 may be coupled to an exhaust silencer, or a pipe coupled thereto.

Coaming 102 may have a lip 104 extending above the surface to which the coaming is coupled, such as to keep water or other fluids from entering system 100. Coaming 102, as well as other components of system 100 may preferably be made of steel, but may be formed from any material required by a particular application. For example, one or more components of system 100 may be fabricated with materials suitable for high temperature engine exhaust associated with a particular application. Each component of system 100 may be painted, coated, or otherwise treated, such as to protect the component from the elements, high temperatures, or otherwise, but need not be.

System 100 may further include a lid, such as hatch 106, for covering coaming 102. Hatch 106 may be made from any material, such as steel, and may include one or more supports, such as stiffening members 136 (FIG. 2), for strengthening the structure of system 100. Hatch 106 may also have a lip, such as rim 108, that may, but need not, extend below the top edge 110 of coaming 102 when hatch 106 is in a particular position, such as in the closed position. While the rim 108 shown in FIG. 2 resides within coaming 102 when system 100 is in the closed position, for example, one of ordinary skill will understand that rim 108 may also be situated outside of edge 110, or both. That is, rim 108 may be larger or smaller in area than coaming 102 or, for example, hatch 106 may include two rims 108 and 109, wherein one is larger and one is smaller in area than coaming 102, so that edge 110 is positioned between the two rims when system 100 is in the closed position. It will be understood that rim 109 is only partially illustrated in FIG. 2.

Hatch 106 may be hingedly coupled to coaming 102, or proximate to coaming 102, to allow hatch 106 to open and close system 100, partially or otherwise. System 100 may include a gasket for forming a sealing engagement between hatch 106 and coaming 102 when, for example, hatch 106 is in the closed position. The gasket may be any type required by a particular application, such as a high-temperature gasket capable of withstanding the heat associated with, for example, the exhaust temperatures of a particular application. The gasket may be made from any material, and may preferably be made from Ferratex cloth. With reference to FIG. 2, the gasket may be coupled to coaming 102, such as along edge 110, or, as another example, the gasket 111 may be coupled to hatch 106, such as along lower edge 138. Alternately, a gasket 111 may be placed between inner ring 108 and outer ring 109 so that the edge 110 forms a knife seal against the gasket 111.

In the embodiment shown in FIGS. 1 and 2, which is but one of many, the system 100 may comprise a locking mechanism 120, which may include one or more hinges, such as hinges 112. Each hinge 112 may include one or more components such as, for example, a hinge blade 114, and one or more hinge pads 116. Each hinge 112 may also include a bar, such as pawl 118, for cooperating with one or more teeth 122 on the associated hinge blade 114. One or more pawls 118 may ratchet against teeth 122 as hatch 106 opens or closes relative to coaming 102 such as, for example, to lock hatch 106 in a particular position required by a particular application, which may be any position, including closed, but preferably opened. Locking mechanism 120 may include one or more springs (not shown), which may bias pawl 118 toward a particular direction or location, such as against teeth 122, as system 100 opens or closes. For example, pawl 118 may be biased against hinge blade 118 in a ratcheting fashion, for example, so that pawl 118 may cooperate with one or more teeth 122, such as to fix hatch 106 in an open position. As hatch 106 opens or closes, hinge blade 114 may slide between a pair of hinge pads 116 such that pawl 118 fixes the angle of hatch 106 relative to coaming 102 at a position defined by one or more teeth 122. Hatch 106 may be opened or closed manually or automatically, such as by a force or pressure applied to system 100 at, for example, handle 124, on the bottom of hatch 106, or another location, in whole or in part. Locking mechanism 120 may be engaged or disengaged manually or automatically, such as by manipulating pawl 118 so that hatch 106 may rotate freely about hinge 112 in either direction. In the exemplary embodiment of FIGS. 1 and 2, hatch 106 is shown in one of many open positions, and more specifically is shown to be in the open position defined by the cooperation of pawl 118 with tooth 126. However, one of ordinary skill will understand that hatch 106 may be rotated to or fixed at any position defined by a particular tooth 122 and that the position of the embodiment shown in FIGS. 1 and 2 is but one of many.

System 100 may include one or more couplers, such as coupler 128, for coupling additional weight to system 100. The embodiment of coupler 128 in FIGS. 1 and 2 is shown for exemplary purposes only and coupler 128 may take any form required by a particular application, as will be understood by one of ordinary skill in the art. Coupler 128 may include one or more supports, such as coupler pads 130, coupled to hatch 106, such as by welding or any other method required by a particular application. One or more coupler pads 130 may support a weight-retaining component, such as a bar or, as another example, rod 132. Coupler 128 may support one or more counterweights 134, which may be coupled, for example, between coupler pads 130. The one or more counterweights 134 may be made from any material, such as steel, and may include any amount of weight required by a particular application, as will be discussed in further detail below.

Counterweights 134 may be coupled to hatch 106 to counterbalance at least a portion of the weight of one or more components of system 100, such as hatch 106 or handle 124, when the system 100 is in the open position. As another example, counterweights 134 may cause, in whole or in part, system 100 to open when system 100 is subject to one or more conditions, such as, for example, when the vessel to which system 100 is coupled undergoes listing, tilting, rocking or other conditions. In at least one embodiment, for example, counterweights 134 may prompt system 100 to open when the system 100 is rotated a particular angle from the horizontal, which may be approximately 20 degrees or any angle required by a particular application.

The open position may include any position, such as, for example, the positions illustrated in FIGS. 1 and 2, wherein a substance, such as engine exhaust gas, may pass through system 100, in whole or in part. As other examples, the open position may include any position wherein hatch 106 is not in sealing engagement with coaming 102 or wherein hatch 106 is not parallel to flange 140 of coaming 102. One of ordinary skill in the art will understand that the weight of one or more counterweights 134 may vary from application to application, and may be determined in light of any number of factors required by a particular application, such as the type or severity of the distress or listing condition of the associated vessel, the canter or slope of the vessel or, as other examples, the weight of hatch 106 or the angles at which hatch 106 may be fixed relative to other components throughout a series of open conditions. The weight of one or more counterweights 134 in a particular application may preferably allow exhaust gases to exit the vessel through the primary exhaust system during normal operating conditions, while allowing the exhaust gases to exit the vessel through system 100 during abnormal conditions.

Figure 3:
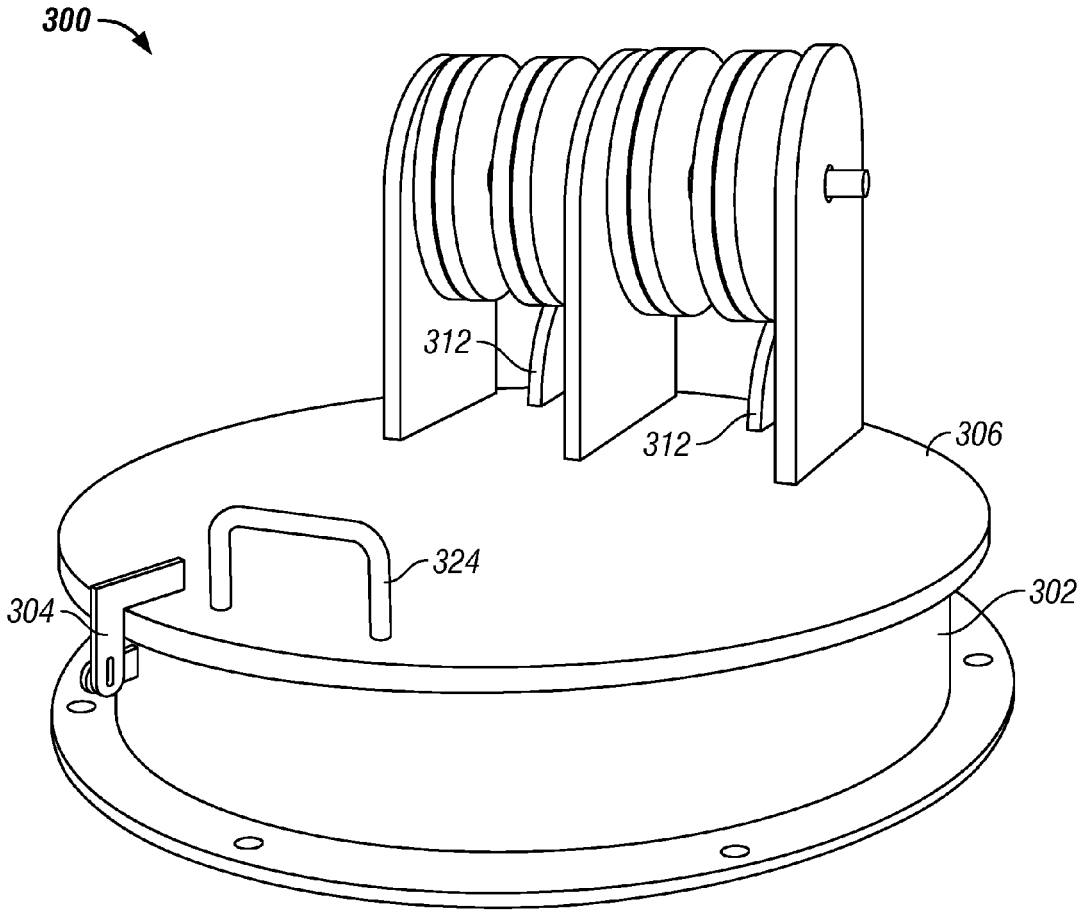
FIG. 3 illustrates another of many embodiments of an engine exhaust bypass system in the closed position and utilizing certain aspects of the present invention.

FIG. 3 illustrates one of many embodiments of an engine exhaust bypass system or valve 300 in the closed position and utilizing certain aspects of the present invention. When valve 300 is in the closed position, for example, coaming 302 and hatch 306 may be in sealing engagement with one another, which may prevent any substance, such as water or engine exhaust, from entering or exiting valve 300. The sealing engagement may, but need not, include the use of a gasket, as described above, or any other device for sealing required by a particular application. Valve 300 may further include hasp 302 for coupling hatch 306 to coaming 302, such as at a location other than that of hinges 312. Hasp 304 may be formed in any manner and at any location required by a particular application and may allow, for example, coaming 302 and hatch 306 to be locked or otherwise secured in the closed position, such as for transport or other purposes. Hasp 304 of FIG. 3 is shown to be separate from handle 324 for exemplary purposes and, alternatively, may be integral with handle 324, as will be appreciated by one of ordinary skill in the art. For example, handle 324 may turn and hasp 302 may include a shank or other device located inside of valve 300.

Figure 4:
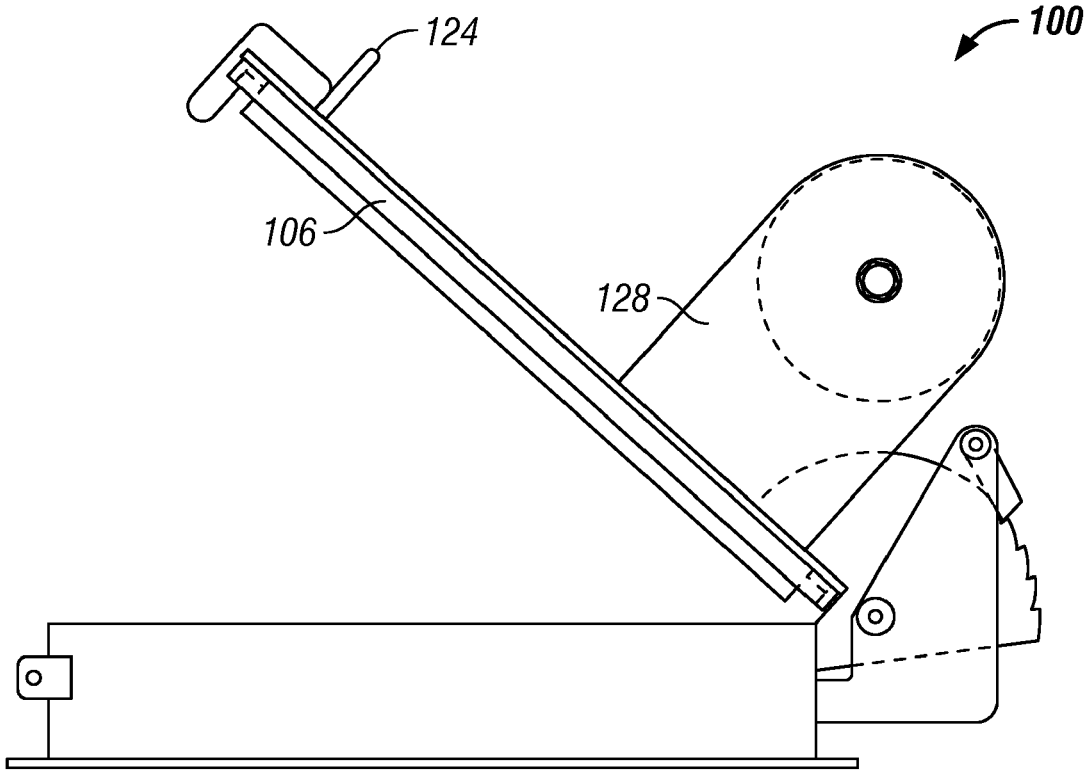
FIG. 4 illustrates another of many embodiments of an engine exhaust bypass system in an opened position and utilizing certain aspects of the present invention.
Figure 5:
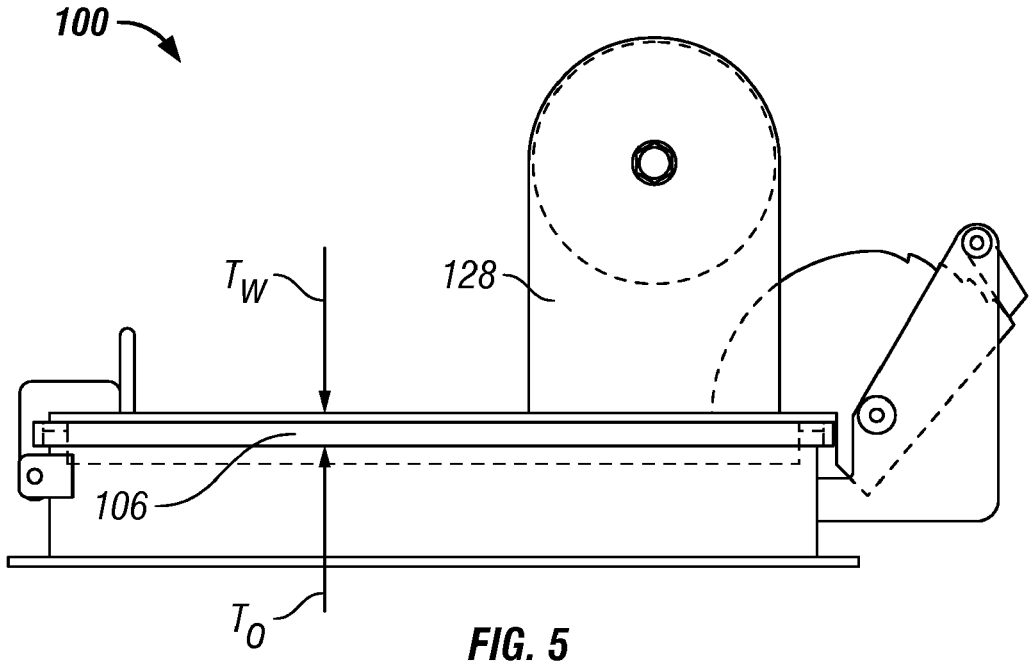
FIG. 5 illustrates the particular embodiment of FIG. 4 in the closed position.

FIG. 4 illustrates another one of many embodiments of engine exhaust bypass relief system 100 in an open position and utilizing certain aspects of the present invention. FIG. 5 illustrates the embodiment of FIG. 4 in the closed position. FIGS. 4 and 5 will be described in conjunction with one another. As described above with respect to one or more other embodiments, the weight of counterweights 134 may be any weight required by a particular application and, for example, may be determined based on any number of factors, such a particular engine, bypass valve, listing angle or, as another example, type of vessel or configuration thereof.

In at least one embodiment, for example, the engine of a particular vessel may produce exhaust, which may flow at a particular pressure during normal operating conditions. The exhaust pressure may exert force, indicated by arrow To in FIG. 5, on hatch 106, for example a force biasing hatch 106 toward an open position, such as the position shown in FIG. 4. Contrariwise, the weight of hatch 106 and other components of system 100, such as coupler 128 or handle 124, may bias hatch 106 toward the closed position, such as the position shown in FIG. 5, for example, wherein the force resultant from the weight of one or more valve components is represented by arrow Tw. In at least one embodiment, but one of many, To may be greater than Tw, which may result in exhaust passing through system 100 when the vessel is operating normally. However, at least one particular application may require that exhaust pass through system 100 only when the vessel is in an upset, or listing, condition. In such an application, for example, weight may be added to coupler 128 so that Tw becomes equal to or greater than To, for example, which may prevent exhaust from passing through system 100, such as when the vessel is operating under normal conditions. On the other hand, when the vessel is operating under upset conditions, system 100 may move to an open position, such as the position shown in FIG. 4, so that, for example, exhaust may pass through system 100 in accordance with a particular application. For example, as the vessel shifts from a normal condition to an upset position, system 100 may open due to Tw becoming less than To, which may result from many factors, such as forces exerted on hatch 106 by exhaust pressure, coupler 128 and counterweights coupled thereto, or other forces, singularly or in combination, as will be described in greater detail below. Any number of factors, such as those described herein and other factors, may determine the amount of counterweight required for a particular application. Likewise, the position or configuration of coupler 128 or counterweights coupled thereto may be any configuration required by a particular application, as will be understood by one of ordinary skill in the art. The design of system 100 or components thereof may vary between applications, considering factors such as exhaust gas volume, temperature, allowable engine backpressure, or other factors. In some embodiments, system 100 may be a bypass valve used to bypass normal engine exhaust flow for emergency purposes only, but it need not be so confined and may be used at any time required by a particular application.

Figure 6:
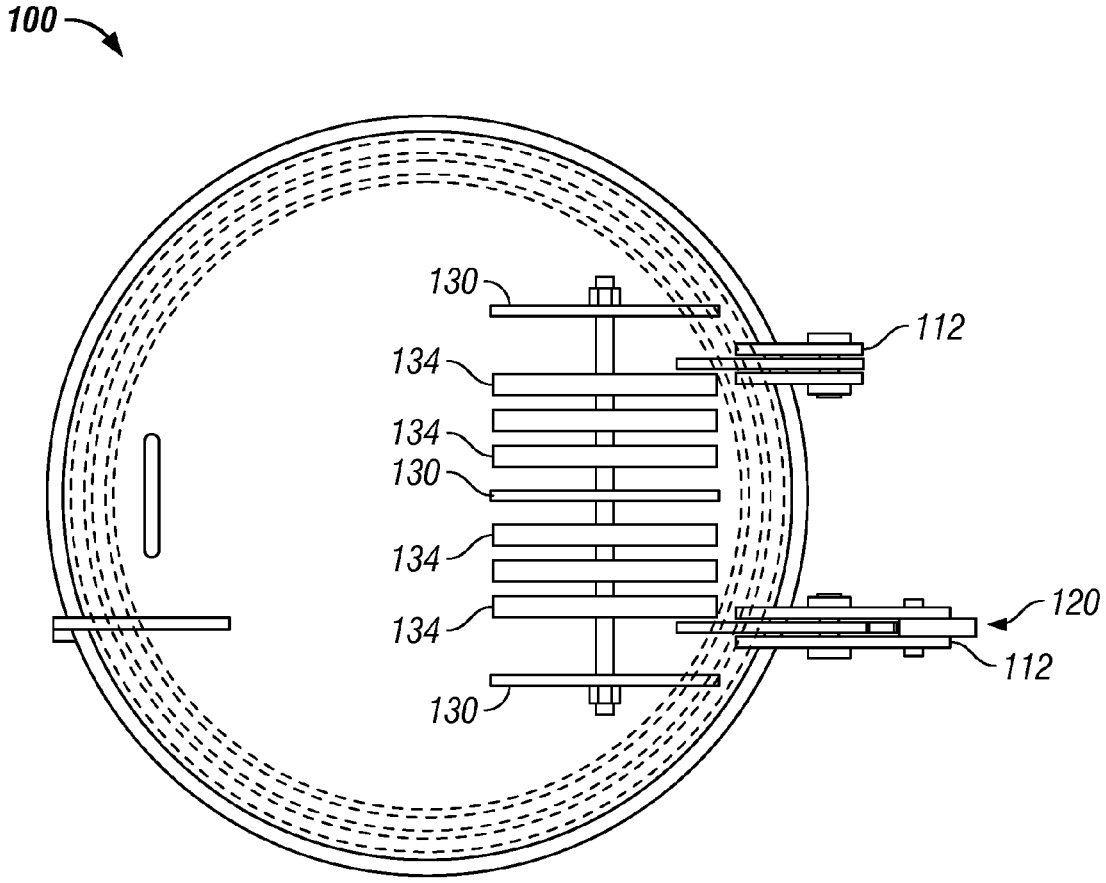
FIG. 6 illustrates another view of the particular embodiment of FIGS. 4 and 5.

FIG. 6 illustrates another view of the embodiment of FIGS. 4 and 5. The embodiment of FIG. 6, which is but one of many, shows two hinges 112 and three coupler pads 130 for illustrative purposes only. One of ordinary skill will understand that system 100 may have any number of hinges 112 or coupler pads 130 required by a particular application. For example, system 100 may include two coupler pads 130 and three hinges 112. Similarly, system 100 is shown in FIG. 5 to have six counterweights 134, but may have any number of counterweights 134 required by a particular application. Likewise, the exemplary embodiment of FIG. 5 shows one locking mechanism 120 associated with a particular hinge 112. However, a particular embodiment of system 100 may include any number of locking mechanisms 120 required by a particular application, such as one for each hinge 112.

Figure 7:
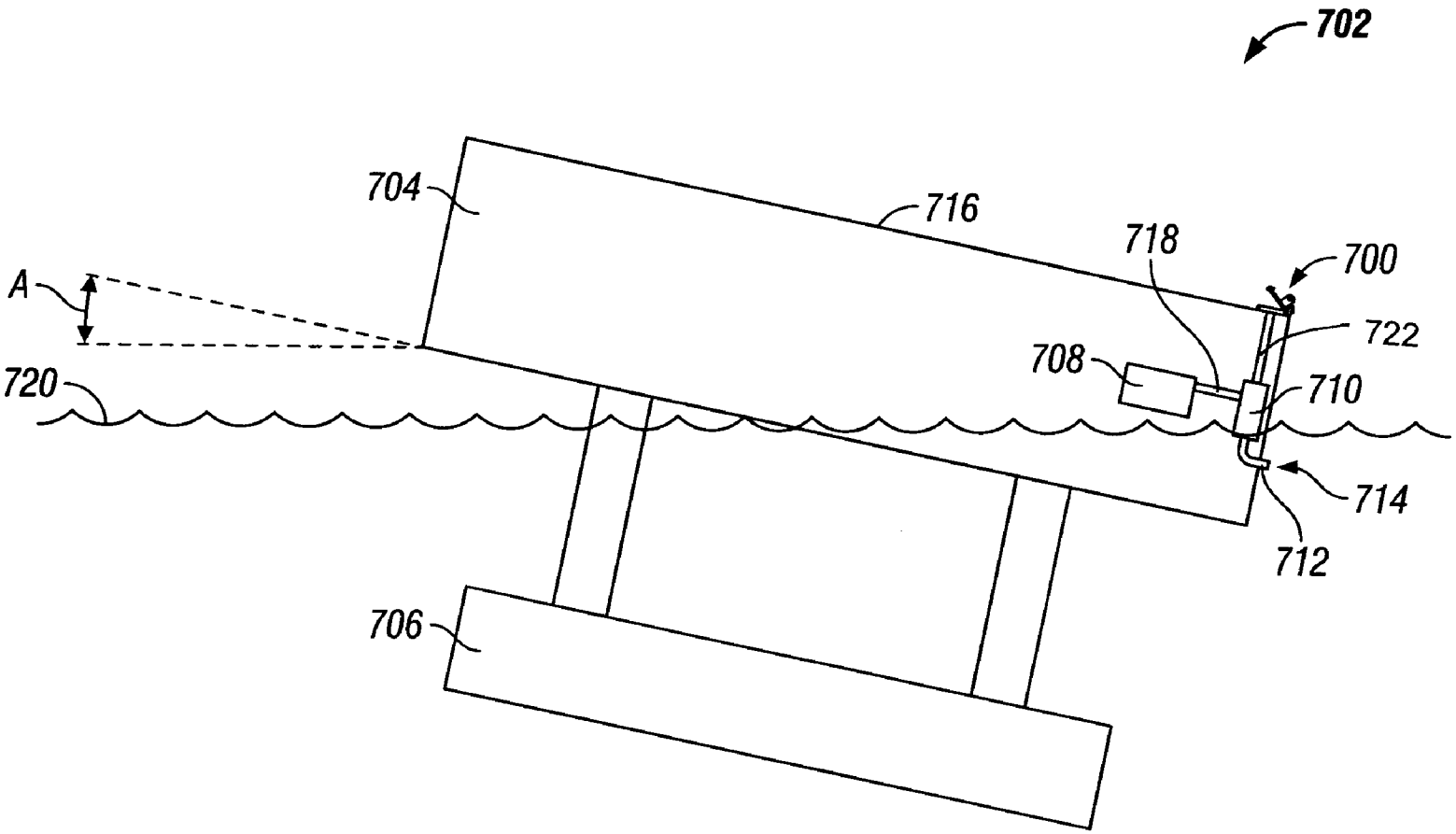
FIG. 7 illustrates a water-borne vessel 702 having an embodiment of an engine exhaust bypass system 700 and utilizing aspects of the present invention.
Figure 8:
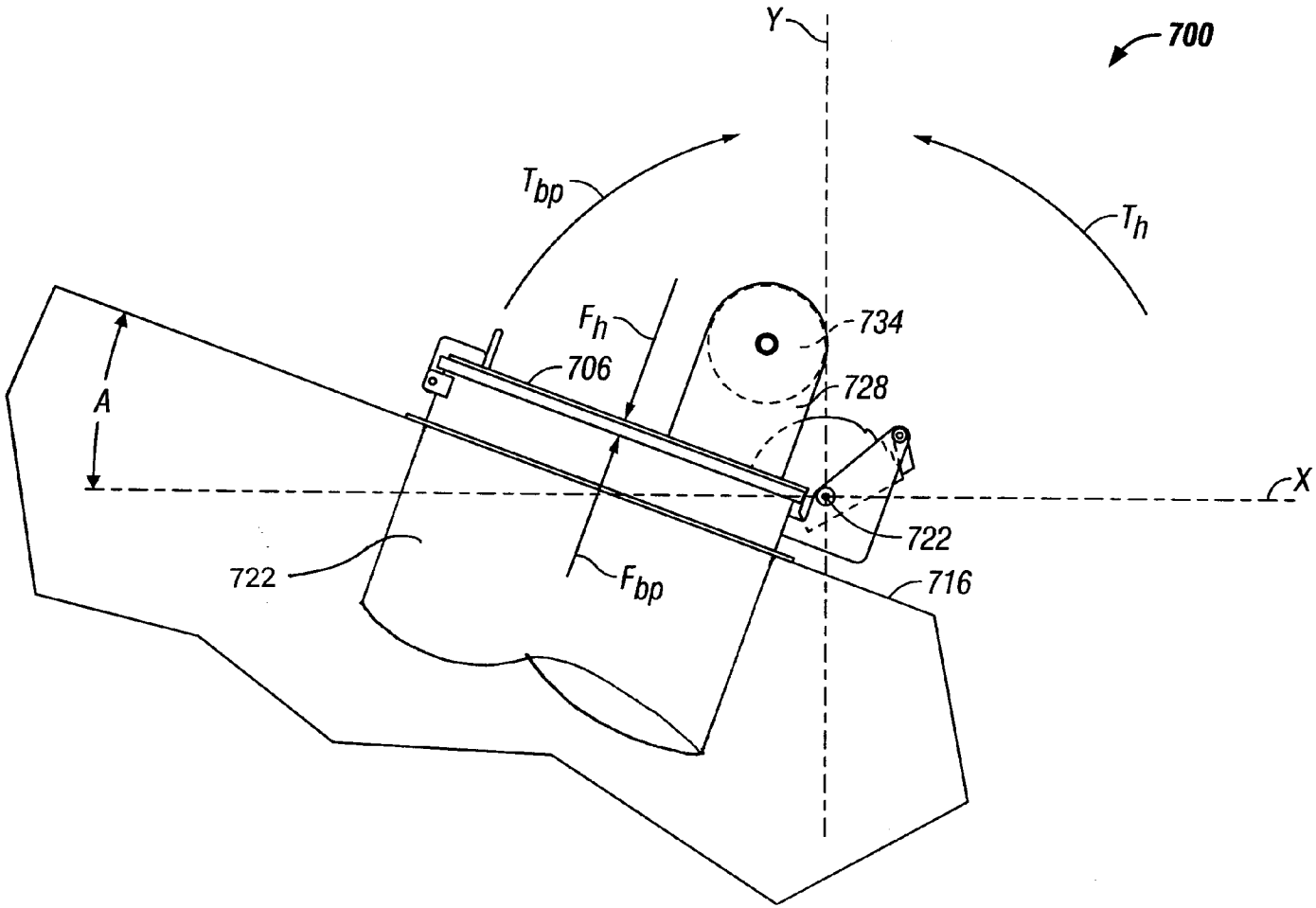
FIG. 8 illustrates another view of the vessel 702 and bypass system 700 of FIG. 7.

FIG. 7 illustrates one of many embodiments of a waterborne vessel 702 having an engine exhaust bypass relief valve 700 and utilizing aspects of the present invention. FIG. 8 illustrates another view of the vessel 702 and bypass relief valve 700 of FIG. 7. FIGS. 7 and 8 will be described in conjunction with one another. One of many exemplary embodiments utilizing certain aspects of the present invention will now be described. FIGS. 7 and 8 and the description herein are for illustrative purposes only and may or may not represent one of many actual applications. One of ordinary skill in the art will understand that any number of factors may be required by a particular application, which may include one or more factors described herein, but need not. One of ordinary skill will also appreciate that the variables and calculations associated with the embodiment shown in FIGS. 7 and 8 may be modeled, mathematically or otherwise, in many ways or manners as required by a particular application and may be a matter of design choice.

A water-going vessel, such as the vessel 702 shown in FIG. 7, for example, may include a deck 704 supported by one or more buoyancy tanks or pontoons 706. Deck 704 may include any number of components required by a particular application such as, for example, an engine 708, an exhaust silencer 710, and an exhaust conduit 712, which may route engine exhaust to exhaust outlet 714 during, for example, normal operations. Deck 704 may also include engine exhaust bypass system or relief valve 700, which may be coupled, for example, to top surface 716 or another location required by a particular application. Valve 700 may be coupled in fluid communication with exhaust outlet 718 of engine 708, or another portion of the engine exhaust system, and may be closed during normal operations of vessel 702 so that no exhaust may be allowed to escape the exhaust system through valve 700.

However, when vessel 702 encounters an upset condition, such as the abnormal orientation or position illustrated in FIGS. 7 and 8, it may be desirable to bypass one or more components of the exhaust system, such as silencer 710 or exhaust conduit 712, so that exhaust may instead exit vessel 702 through valve 700. For example, an embodiment such as the one illustrated in FIGS. 7 and 8 and described herein, which is but one of many, may require, for example, that the engine exhaust backpressure stay below a particular maximum static pressure. More specifically, engine 708 may not function properly, such as failing to start, when a listing condition or abnormal orientation results in exhaust outlet 714 being below water line 720, which may cause, for example, an increase in backpressure sufficient to prevent engine 708 from starting or continuing to run. For example, the application may require that the engine exhaust backpressure remain below the static pressure exerted by water at a particular depth, or water gauge pressure. Accordingly, valve 700 may be designed to open, which may include locking open as described above, when, for example, the exhaust backpressure exceeds a predetermined water gauge pressure required by a particular application. That is, while exhaust from engine 708 may travel through silencer 710, conduit 712, and out of outlet 714 during normal operating conditions of vessel 702, valve 700 may allow the exhaust to bypass the normal exhaust system, flow through bypass conduit 722 and exit through valve 700 when vessel 702 encounters a predetermined condition, such as a particular listing angle A, which may be any angle or abnormal orientation required by a particular application.

With reference to FIG. 8, one example of an embodiment of valve 700 will now be described. The variables and calculations used herein are used for illustrative purposes only and do not necessarily represent a specific application. As an example, which is but one of many, a particular application may require a particular maximum static water gauge (w.g.) exhaust backpressure P. One of ordinary skill will understand that backpressure may exert one or more forces on one or more components of the system, such as on hatch 706 ($F_{bp}$ in FIG. 8), which may create a clockwise torque $T_{bp}$ acting about hinge pin 722, shown in FIG. 8 with imaginary x- and y-axes centered thereon. The weight of hatch 706 and one or more components coupled thereto may exert an opposite force ($F_h$ in FIG. 8) on hatch 706, which may create a counterclockwise torque $T_h$ acting about hinge pin 722. The forces and torques discussed herein are for illustrative purposes only and one of ordinary skill in the art will understand that the forces and torques may have any number of components acting in any direction required by a particular application. In at least one embodiment, one or more counterweights 734 may be coupled to coupler 728, such as to ensure that $T_h$ is equal to or greater than $T_{bp}$ under normal operating conditions and at listing conditions up to and including angle A. For example, when $T_h$ is equal to or greater than $T_{bp}$, valve 700 may be closed such that no exhaust may pass there through. However, once a predetermined degree of listing or abnormal orientation is encountered, such as, for example, when angle A is exceeded, which may be any angle required by a particular application, $T_{bp}$ may become greater than $T_h$, which may cause, but need not cause, hatch 706 to open allowing engine exhaust to exit valve 700 and bypass outlet 714, in whole or in part.

Of course, one of ordinary skill in the art will understand that the example discussed herein is for illustrative purposes only and that the calculations, methods and variables discussed herein my change from application to application and may or may not include any or all of the considerations discussed in the present example. For example, the forces and torques acting on or about various components may have any number of components required by a particular application, but are simplified herein for purposes of clarity and understanding. Many of the variables described herein, such as the weight of hatch 706, the location and amount of weights 734 or, as another example, the listing angle A may be a matter of design choice for a particular application, and were described herein generally in an effort to enable one having benefit of the present disclosure to make and use the present inventions.

Other and further embodiments utilizing one or more aspects of the inventions described above can be devised without departing from the spirit of Applicant's invention. For example, the bypass may be of any shape and may be coupled to any vessel, such as vessels located in a river, lake, other body of water, or elsewhere. Further, the various methods and embodiments of the engine exhaust bypass system can be included in combination with each other to produce variations of the disclosed methods and embodiments. Discussion of singular elements can include plural elements and vice-versa.

The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The inventions have been described in the context of preferred and other embodiments and not every embodiment of the invention has been described. Obvious modifications and alterations to the described embodiments are available to those of ordinary skill in the art. The disclosed and undisclosed embodiments are not intended to limit or restrict the scope or applicability of the invention conceived of by the Applicants, but rather, in conformity with the patent laws, Applicants intend to fully protect all such modifications and improvements that come within the scope or range of equivalent of the following claims.

What is claimed is:

1. A primary exhaust bypass system for a water-borne vessel, comprising:

a seat member;

a closure member hingedly coupled to the seat member to provide a closed position and at least one opened position the closure and seat members configured to seal against exhaust leakage in the closed position and to allow exhaust to flow there through in the opened condition;

a locking mechanism configured to lock open the closure member when the closure member is opened; and wherein the bypass system is configured to open when the vessel lists a predetermined amount and a primary exhaust outlet is blocked.

2. The system of claim 1, further comprising a sealing gasket between the seat member and the closure member.

3. The system of claim 1, wherein the locking mechanism is associated with a hinge.

4. The system of claim 1, wherein the blockage is caused by submersion of the primary exhaust outlet under water.

5. The system of claim 1, wherein the closure member has added weight to ensure that is remains closed under normal conditions and to open upon abnormal conditions.

6. An exhaust system for a water-borne vessel, comprising:

a primary exhaust subsystem comprising a primary conduit and a primary outlet, a bypass exhaust subsystem comprising a bypass conduit coupled to the primary conduit and a bypass outlet;

a bypass mechanism coupled to the bypass outlet and comprising:

an annularly-shaped seat member;

a closure member hingedly coupled to the seat member to provide a closed position and at least one opened position;

the closure and seat members configured to seal against exhaust leakage in the closed position and to allow exhaust to flow through the bypass outlet in the opened condition;

a locking mechanism configured to lock open the closure member when the closure member is opened; and wherein the bypass mechanism is configured to open when the vessel lists a predetermined amount and the primary outlet is at least partially blocked.

7. A method of bypassing a blocked primary exhaust system, comprising:

establishing a bypass of the primary exhaust system;

providing a normally-closed bypass mechanism at a distal portion of the primary exhaust bypass; the bypass mechanism comprising:

a seat member;

a closure member hingedly coupled to the seat member to provide a closed position and at least one opened position;

the closure and seat members configured to seal against exhaust leakage in the closed position and to allow exhaust to flow through the bypass in the opened condition;

a locking mechanism configured to lock open the closure member when the closure member is opened; and wherein the bypass mechanism is configured to open when the orientation of the bypass mechanism with respect to gravity changes by a predetermined amount and the primary exhaust system is at least partially blocked; and bypassing the primary exhaust system when the orientation of the bypass mechanism changes with respect to gravity and the primary exhaust system is at least partially blocked.

8. An engine exhaust bypass valve for ocean vessels, comprising:

an annular coaming;

a hatch hingedly coupled to the coaming, the hatch having a lip that extends below a top edge of the coaming when the hatch is in a closed position;

a locking mechanism to fix the position of the hatch relative to the coaming, wherein the locking mechanism includes a pawl that ratchets against teeth of a hinge blade to fix a position of the hatch relative to the coaming; and at least one counterweight coupled to the hatch so that the counterweight counterbalances at least a portion of the weight of the hatch when the hatch is in an open position.

9. The bypass valve of claim 8, further comprising a gasket that forms a seal between the hatch and the coaming when the hatch is in the closed position.

10. The bypass valve of claim 9, wherein the gasket is capable of withstanding engine exhaust temperatures.

11. The bypass valve of claim 8, further comprising a lift handle coupled to the hatch.

12. The bypass valve of claim 8, further comprising a hasp that couples the hatch to the coaming.

13. The bypass valve of claim 8, wherein the coaming is coupled to a primary exhaust system bypass conduit.

14. The bypass valve of claim 8, wherein the locking mechanism is configured to lock the hatch in the open position.

15. The bypass valve of claim 8, wherein the locking mechanism is configured to selectively prevent the hatch from closing.

16. The bypass valve of claim 8, wherein the pawl is biased toward the teeth in order to engage a selected one of the teeth to lock the hatch in a selected one of a plurality of positions relative to the coaming.

17. The bypass valve of claim 8, wherein the locking mechanism is configured to selectively lock the hatch in one of a plurality of positions relative to the coaming.

18. A method of manufacturing an engine exhaust bypass valve for ocean vessels, comprising:

forming a bypass valve having a coaming, a hatch hingedly coupled to the coaming, and a counterweight coupler coupled to the hatch;

calculating the force required to maintain the valve in a closed condition under normal vessel and engine operating conditions;

determining additional weight to be added to the hatch based on the closed force calculation to keep the valve in the closed condition under normal vessel and engine operating conditions;

calculating the force exerted on the hatch by engine exhaust when a primary exhaust system is blocked;

calculating a position of the additional weight on the hatch so that the blocked exhaust force and the additional weight will automatically open the valve when the vessel is in a predetermined abnormal orientation;

installing the additional weight on the hatch at the calculated position.

19. A method of bypassing a blocked primary engine exhaust on a listing ocean vessel, comprising:

providing a bypass valve having a coaming, a hatch hingedly coupled to the coaming and defining a closed and an opened condition;

determining additional weight to be added to the hatch to keep the valve closed during normal vessel and engine operating conditions;

adding the determined weight to the hatch;

coupling the bypass valve in communication with the primary engine exhaust of the vessel;

upsetting the normal orientation of the vessel;

blocking the primary exhaust to increase the pressure tending to open the bypass valve; and automatically opening the hatch based on the increased pressure and the abnormal orientation to thereby allow exhaust to pass through the valve.

* * * * *